US008847092B2

(12) United States Patent
Kudrna et al.

(10) Patent No.: US 8,847,092 B2
(45) Date of Patent: Sep. 30, 2014

(54) HYBRID KEYPAD APPARATUS

(75) Inventors: John Paul Kudrna, Naperville, IL (US); Dietmar Frank Wennemer, St. Agatha (CA)

(73) Assignee: BlackBerry Limited, Waterloo, Ontario ( * ) Notice: Subject to any disclaimer, the term of this patent is extended or adjusted under 35 U.S.C. 154(b) by 80 days.

(21) Appl. No.: 13/561,914

(22) Filed: Jul. 30, 2012

(65) Prior Publication Data

US 2014/0027254 A1 Jan. 30, 2014

(51) Int. Cl.
*H01H 1/10* (2006.01)
*H01H 5/18* (2006.01)

(52) U.S. Cl.
USPC ..... 200/516; 200/406

(58) Field of Classification Search
USPC ..... 200/310, 5 A, 5 R, 511–513, 520, 521, 200/308, 311, 313, 314, 317, 337, 341, 343, 200/345, 292, 329, 406, 516; 379/433.07
See application file for complete search history.

(56) References Cited

U.S. PATENT DOCUMENTS

| | | | | |
|---|---|---|---|---|
| 7,902,474 | B2 * | 3/2011 | Mittleman et al. | 200/516 |
| 2008/0019502 | A1 | 1/2008 | Emmert et al. | |
| 2009/0194401 | A1 * | 8/2009 | Kim | 200/314 |
| 2010/0084252 | A1 | 4/2010 | Rajagopal et al. | |

FOREIGN PATENT DOCUMENTS

| | | |
|---|---|---|
| EP | 1748515 | 1/2007 |

OTHER PUBLICATIONS

European Patent Office, "European Search Report," issued in connection with European application serial No. 12 178 435.9, issued Feb. 19, 2013, 6 pages.

* cited by examiner

*Primary Examiner* — Renee S Luebke
*Assistant Examiner* — Anthony R. Jimenez
(74) *Attorney, Agent, or Firm* — Hanley, Flight & Zimmerman, LLC.

(57) ABSTRACT

Hybrid keypad apparatus are disclosed herein. An example hybrid keypad apparatus includes a dome-switch assembly having a first plurality of domes composed of a first material and a second plurality of domes composed of a second material different from the first material. A carrier couples the first and second plurality of domes.

20 Claims, 8 Drawing Sheets

HYBRID KEYPAD APPARATUS

FIELD OF DISCLOSURE

The present disclosure relates to mobile devices, including but not limited to, hybrid keypad apparatus.

BACKGROUND

Electronic devices, including portable electronic devices, have gained widespread use and may provide a variety of functions including, for example, telephonic, electronic messaging, and other personal information manager (PIM) application functions. Portable electronic devices include, for example, several types of mobile stations such as simple cellular telephones, smart telephones, wireless personal digital assistants (PDAs), and laptop computers with wireless 802.11 or Bluetooth capabilities.

Portable electronic devices such as PDAs or smart telephones are generally intended for handheld use and ease of portability. With continued demand for decreased size of portable electronic devices, electronic devices continue to decrease in size. Often these portable electronic devices include physical keypads (e.g., depressible keys, plastic keys, etc.) to input information such as data entry and display control. One benefit of a physical keypad is that it typically provides tactile feedback to a user. The tactile feedback from the keypad can be provided in a variety of ways including the use of one or more collapsible dome switches associated with or corresponding to one or more depressible keys of a keypad.

Smaller devices are generally desirable for portability. However, use of keypads that employ collapsible dome switches composed of metal may not overlap an antenna or antenna region of the electronic device because metal collapsible domes may interfere or reduce antenna performance. As a result, a keypad employing a metal collapsible dome is typically positioned away from the antenna and/or the antenna region resulting in an electronic device having a larger dimensional envelope or size.

DETAILED DESCRIPTION

Figure 1:
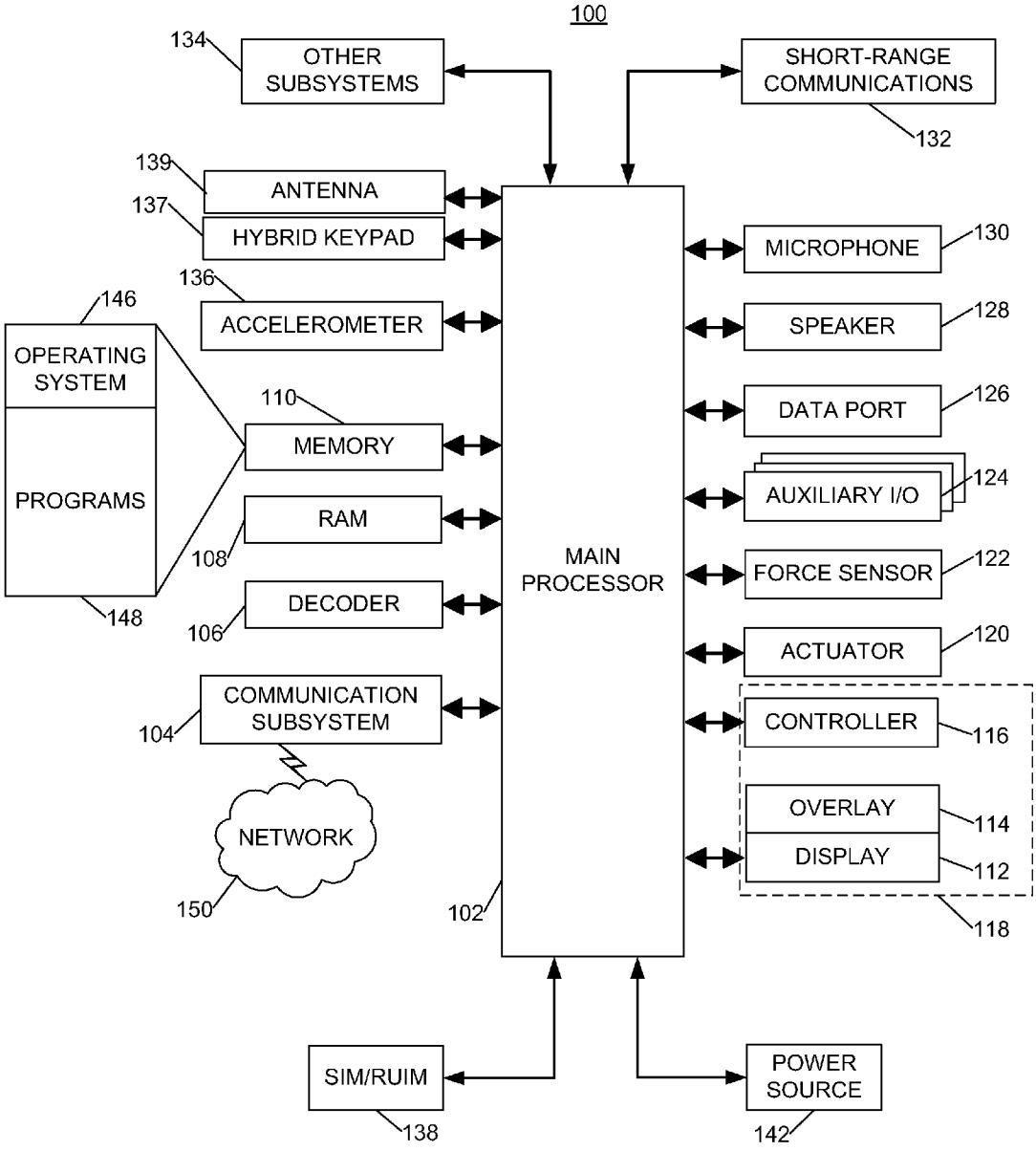
FIG. 1 is a block diagram of an example portable electronic device in accordance with the teachings disclosed herein.

Typically, wireless communication devices that transmit and/or receive signals employ an antenna. The antenna of the wireless communication device is typically positioned or spaced away from peripheral metal components (e.g. metal that is not part of the antenna itself) of an electronic device to prevent degradation of antenna performance. For example, an electronic or portable mobile device often employs a keypad apparatus having a tactile response (e.g., a physical keypad) that includes a metallic dome array or metal domes. A metal dome array is often employed because metal domes provide a relatively high cycle life and/or superior tactile feedback. However, known keypad apparatus having a metal dome array cannot share or overlap an antenna region of the electronic device without negatively affecting antenna performance or accuracy. As a result, an electronic device employing a keypad apparatus having a metal dome array often has a relatively larger dimensional envelope to provide or accommodate a dedicated antenna region outside or without overlap with the metal dome array.

Example keypad apparatus and methods disclosed herein provide tactility and/or reduce an overall dimensional envelope of an electronic apparatus. To provide tactile feedback and generate an electrical signal when a key of the keypad apparatus is activated, the keypad apparatus employs an electrical switch. An example electrical switch described herein may include one or more collapsible dome switches associated with, or corresponding to, depressible keys of a keypad and contacts of a printed circuit board. For example, a dome switch of the example keypad apparatus disclosed herein collapses toward the contact of the printed circuit board to generate an electrical signal when a key is activated.

More specifically, the example keypad apparatus disclosed herein employs a hybrid dome array having at least one dome switch composed of metal and at least one dome switch composed of non-metal material (e.g., plastic) to provide a hybrid dome array. As a result of employing metallic and non-metallic domes, the example keypad apparatus disclosed herein may be positioned in a housing of the electronic device and can overlap an antenna region while maintaining a relatively high cycle life. In particular, the non-metallic domes of the keypad apparatus may overlap with an antenna or antenna region of an electronic device, resulting in an electronic device having a relatively smaller overall dimensional envelope or footprint without affecting or reducing antenna performance (e.g., without significantly interfering with antenna performance) and the metal domes provide a relatively high cycle life. Further, both the metallic domes and non-metallic domes of the dome array provide tactile feedback. In other words, the non-metallic portions of the switch array do not significantly compromise tactile performance.

Employing a hybrid dome array disclosed herein provides a relatively high cycle life physical keypad apparatus that can overlap with an antenna region resulting in a smaller electronic device without negatively affecting antenna performance. In some examples, non-metallic flexible domes are strategically positioned on the dome array and/or may be positioned along a perimeter edge of the dome array. Generally, a non-metal dome may be positioned adjacent a metal dome. For example, a non-metallic flexible dome representative and/or associated with a key that is less commonly or seldom used (e.g., an alternate key command) can be positioned to overlap an antenna region or antenna perimeter of an electronic device. By replacing a metal dome or metal switch of a low use key with a plastic actuator or dome having localized conductive traces provides relatively less metal content positioned within or violating an antenna region to improve antenna performance. An example keypad described herein can be used to implement a portable electronic device such as, for example, a mobile or cellular device to provide a more compact or smaller mobile device.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

The disclosure generally relates to an electronic device, such as a portable electronic device as described herein. Examples of electronic devices include mobile, or handheld, wireless communication devices such as pagers, cellular phones, cellular smart-phones, wireless organizers, personal digital assistants, wirelessly enabled notebook computers, tablet computers, mobile internet devices, electronic navigation devices, and so forth. The electronic device may be a portable electronic device without wireless communication capabilities, such as a handheld electronic game, digital photograph album, digital camera, media player, e-book reader, and so forth.

A block diagram of an example portable electronic device 100 is shown in FIG. 1. The electronic device 100 includes multiple components, such as a processor 102 that controls the overall operation of the electronic device 100. Communication functions, including data and voice communications, are performed through a communication subsystem 104. Data received by the electronic device 100 is decompressed and decrypted by a decoder 106. The communication subsystem 104 receives messages from and sends messages to a wireless network 150. The wireless network 150 may be any type of wireless network, including, but not limited to, data wireless networks, voice wireless networks, and networks that support both voice and data communications. A power source 142, such as one or more rechargeable batteries or a port to an external power supply, powers the electronic device 100.

The processor 102 interacts with other components, such as a Random Access Memory (RAM) 108, memory 110, a touch-sensitive display 118, one or more actuators 120, one or more force sensors 122, an auxiliary input/output (I/O) subsystem 124, a data port 126, a speaker 128, a microphone 130, short-range communications 132 and other device subsystems 134, a hybrid keypad 137, an antenna 139, etc. More specifically, at least a portion of the hybrid keypad 137 may overlap at least a portion of the antenna 139 when the hybrid keypad 137 and the antenna 139 are positioned within the electronic device 100. The touch-sensitive display 118 includes a display 112 and an overlay 114 that are coupled to at least one controller 116 that is utilized to interact with the processor 102. Input via a graphical user interface is provided via the touch-sensitive display 118 and/or the hybrid keypad apparatus 137. Information, such as text, characters, symbols, images, icons, and other items that may be displayed or rendered on the hybrid keypad apparatus 137 of the portable electronic device and/or may be displayed on the touch-sensitive display 118 via the processor 102. The processor 102 may also interact with an accelerometer 136 that may be utilized to detect direction of gravitational forces or gravity-induced reaction forces.

To identify a subscriber for network access, the electronic device 100 may utilize a Subscriber Identity Module or a Removable User Identity Module (SIM/RUIM) card 138 for communication with a network, such as the wireless network 150. Alternatively, user identification information may be programmed into memory 110.

The electronic device 100 includes an operating system 146 and software programs, applications, or components 148 that are executed by the processor 102 and are typically stored in a persistent, updatable store such as the memory 110. Additional applications or programs may be loaded onto the portable electronic device 100 through the wireless network 150, the auxiliary (I/O) subsystem 124, the data port 126, the short-range communications subsystem 132, or any other device subsystems 134.

A received signal such as a text message, an e-mail message, or web page download is processed by the communication subsystem 104 and input to the processor 102. The processor 102 processes the received signal for output to the display 112 and/or to the auxiliary (I/O) subsystem 124. A subscriber may generate data items, for example e-mail messages, which may be transmitted over the wireless network 150 through the communication subsystem 104. For voice communications, the overall operation of the electronic device 100 is similar. The speaker 128 outputs audible information converted from electrical signals, and the microphone 130 converts audible information into electrical signals for processing.

The touch-sensitive display 118 may be any suitable touch-sensitive display, such as a capacitive, resistive, infrared, surface acoustic wave (SAW) touch-sensitive display, strain gauge, optical imaging, dispersive signal technology, acoustic pulse recognition, and so forth. A capacitive touch-sensitive display includes one or more capacitive touch sensors or overlay 114. The capacitive touch sensors may comprise any suitable material, such as indium tin oxide (ITO). In other examples, the electronic device 100 may include a non-touch sensitive display instead of, and/or in addition to, the touch-sensitive display 118.

Figure 2:
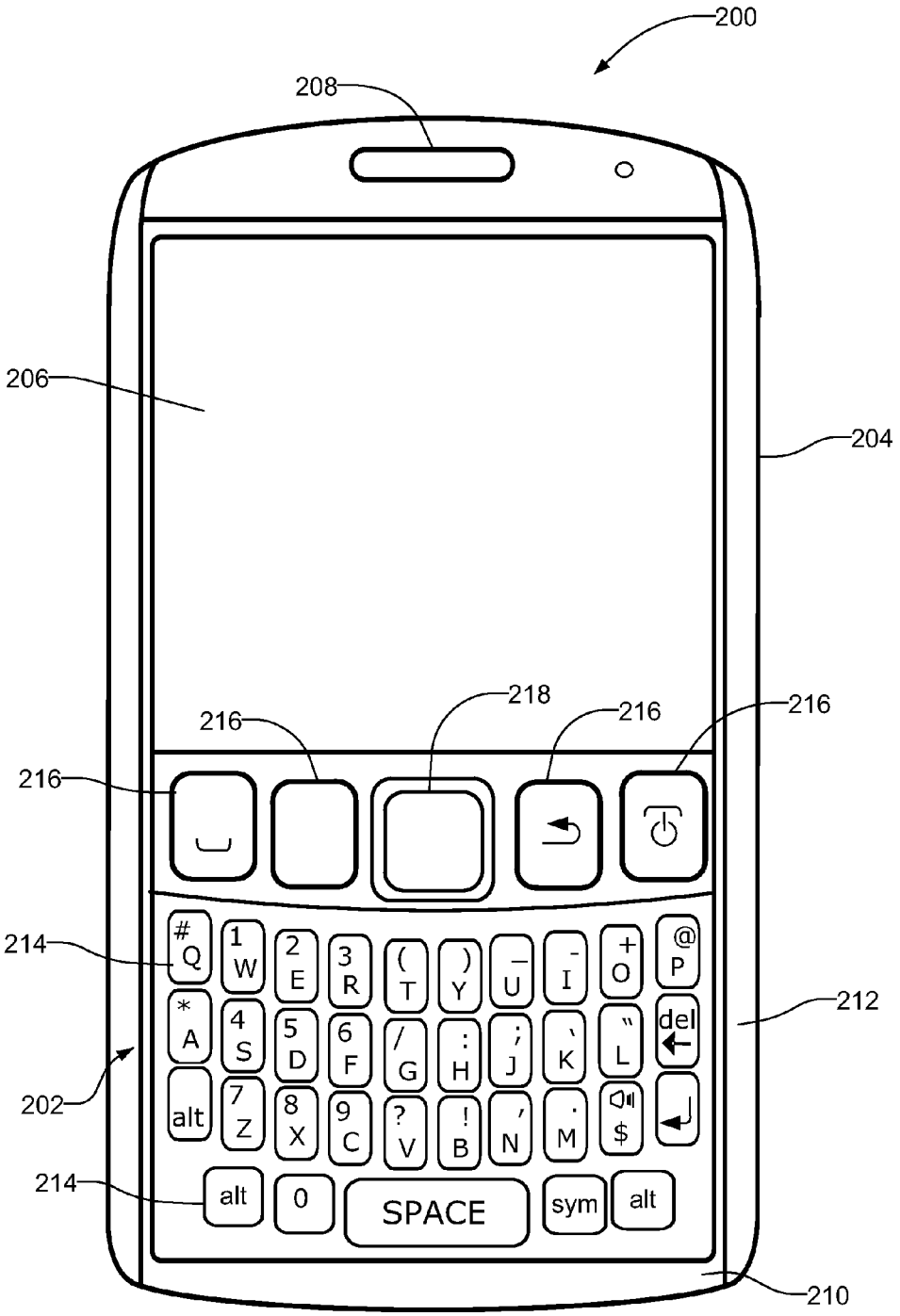
FIG. 2 is an example portable electronic device of FIG. 1 implemented with an example keypad apparatus in accordance with the teachings disclosed herein.

FIG. 2 is a front view of a portable electronic device 200 having a keypad apparatus or assembly 202 in accordance with the teachings disclosed herein. In the example of FIG. 2, the portable electric device 200 is a handheld or portable communication device (e.g., a mobile phone). As mentioned above, the electronic device 200 may be a data and/or voice-enabled handheld device that may be used to send and receive a message, a voice communication, a textual entry, etc. Referring to FIG. 2, the electronic device 200 includes a housing 204 that encloses electronic or mobile components such as, for example, the electronic components described above in connection with FIG. 1. For example, the housing 204 encloses the keypad apparatus 202, a display 206, a speaker 208, a microphone, an auxiliary I/O, a data port, etc. The housing 204 may include a front cover or lid 210 that couples to a frame or base 212 to capture the electronic components within the housing 204. The housing 204 of the illustrated example can be held in one hand by a user of the electronic device 200 during data (e.g., text) and/or voice communications.

In the example of FIG. 2, the display 206 is located adjacent or above the keypad apparatus 202. To provide a user input and accommodate textual inputs to the electronic device 200, the keypad apparatus 202 includes a plurality of keys or key switch assemblies 214. When assembled with the housing 204, each of the keys 214 is positioned within an opening of the front cover 210 and projects from the front cover 210. The keys 214 enable character inputs including alphabetical and/or numeric entries to allow text and/or numeric entry for various functions. For example, the keypad apparatus 202 may be a QWERTY style keypad, a SureType keypad, or any other suitable keypad(s). In some examples, less frequently used keys 214 may be positioned adjacent a perimeter of the keypad apparatus 202 and more frequently used keys may be positioned toward a central region of the keypad apparatus 202 (e.g., spaced away from the perimeter edge). In this example, the electronic device 200 also includes function keys 216. For example, the function keys 216 may include an on/off button or call end button, a call send button, a menu button, an escape key, etc. The electronic device 200 may also include a trackpad or track ball 218 to input information and/or control commands.

A user interacts with the electronic device 200 via the keys 214, the function keys 216 and/or the track pad 218 of the keypad apparatus 202 to choose commands, execute application programs, and perform other functions by selecting menu items or icons. Additionally or alternatively, in some examples, the electronic device 200 may include a touch-sensitive display (e.g., the touch-sensitive display 118 of FIG. 1). In combination with the keypad apparatus 202, a user may interact with the electronic device 200 via the touch-sensitive display to choose commands, execute application programs, and perform other functions by selecting menu items or icons by contacting or touching the icon or image via the touch screen.

Figure 3:
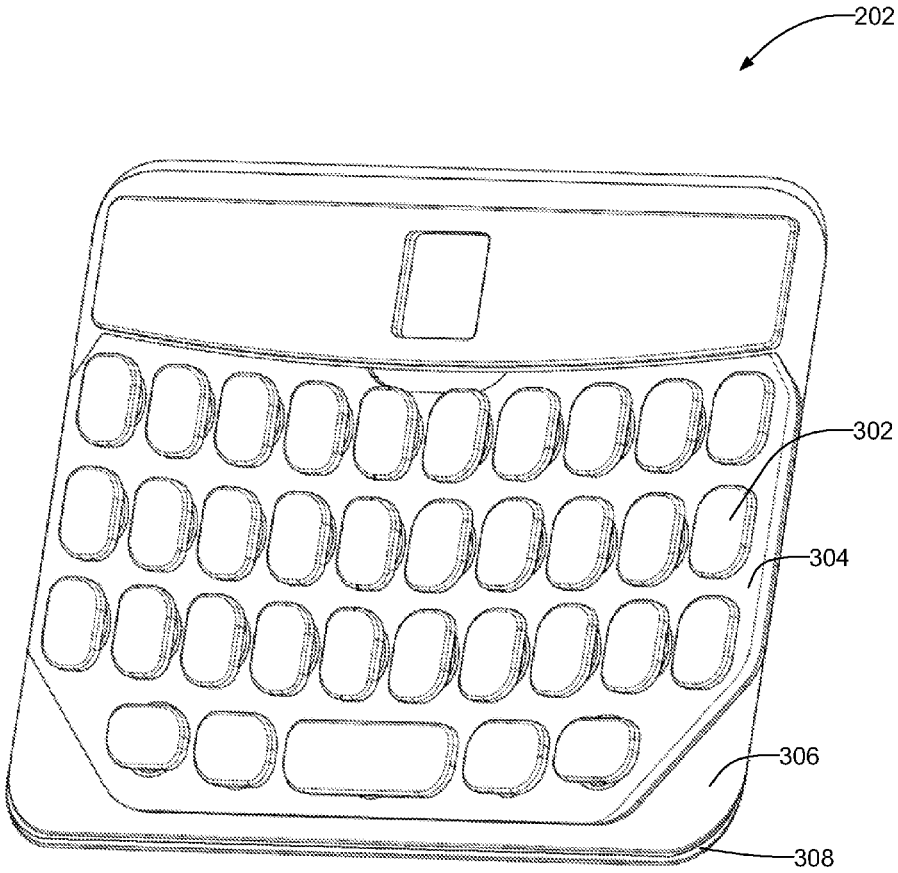
FIG. 3 is perspective view of the example keypad apparatus of the example electronic device of FIG. 2.

FIG. 3 illustrates a perspective view of the example keypad apparatus 202 of FIG. 2. The keypad apparatus 202 includes a plurality of keycaps 302, a keyweb or rubber-like pad 304, a hybrid dome array 306 (e.g., a dome switch) and a printed circuit board 308 (e.g., a flexible printed circuit board). Although not shown, in some examples, the keypad apparatus 202 may include a light guide film to deflect/reflect light from a light source (e.g., mounted on the printed circuit board 308) toward the keycaps 302. In some examples, adhesive may be used to secure the hybrid dome array 306 to the printed circuit board 308 and/or adhesive may be used to secure or attach the keycaps 302 to the keyweb 304.

Figure 4:
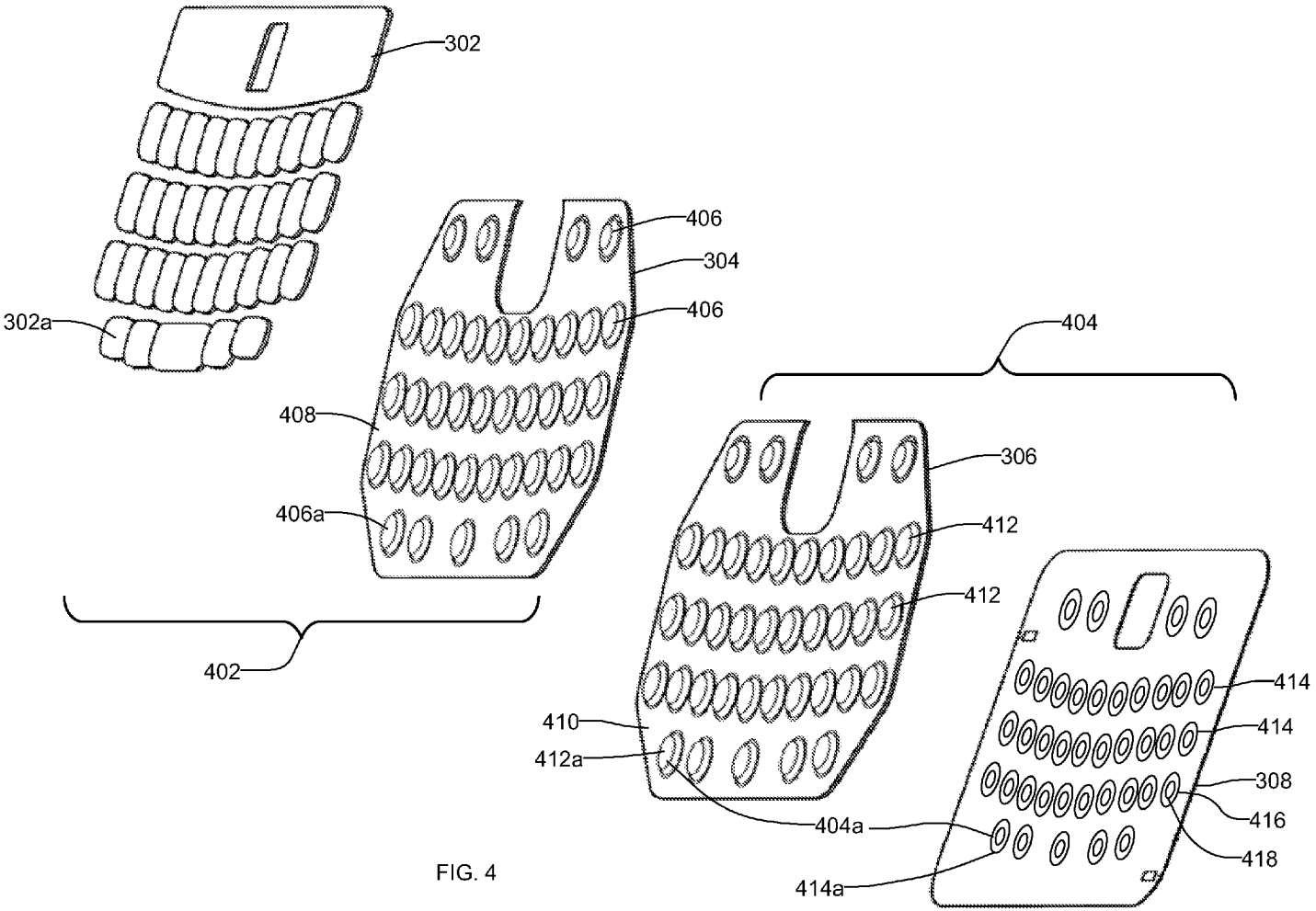
FIG. 4 is an exploded view of the example keypad apparatus of FIGS. 2 and 3.

FIG. 4 illustrates an exploded view of the example keypad apparatus 202 of FIGS. 2 and 3. The keypad apparatus 202 of the illustrated example includes an actuator assembly 402 positioned above or over an electrical switch 404. The actuator assembly 402 interacts with the electrical switch 404 to generate an electrical signal when a user depresses one of the respective keys 214 associated or corresponding to the electric switch 404.

The actuator assembly 402 of the illustrated example includes the keycaps 302 and the keyweb 304. Although not shown in FIG. 4, the keycaps 302 may include indicia or graphics representing different (e.g., alphanumeric) character inputs. The graphic portion or indicia of the keycaps 302 may be composed of a transparent or translucent material or layer (or a semi-transparent or semi-translucent material) and a non-graphic portion of the keycaps 302 may be composed of an opaque material or layer.

In the illustrated example, the keyweb 304 is a relatively thin layer that includes a plurality of plungers, actuators or dome shaped members 406 that are interconnected via a sheet 408 (e.g., a rubber sheet). In the illustrated example, each of the actuators 406 protrudes from the sheet 408 and is associated with respective ones of the keycaps 302.

The electrical switch 404 of the illustrated example includes the dome array 306 positioned over the printed circuit board 308 (e.g., a flexible printed circuit board). The dome array 306 includes a dome sheet or carrier 410 (e.g., a film) that interconnects and/or defines a plurality of dome switches or domes 412. The dome switches 412 are positioned over respective trace patterns 414 of the printed circuit board 308 so that a conductive contact surface (e.g., an apex) of each of the dome switches 412 is aligned relative to conductive contacts 416 and 418 of the respective trace patterns 414. In this example, the number of dome switches 412 corresponds to the number of actuators 406 such that each of the keys 214 of the keypad apparatus 202 is associated with a respective one of the dome switches 412. The dome switches 412 may be provided in a grid pattern and may be spaced (e.g., evenly, unevenly, etc.) relative to one another. Also, in this example, each of the dome switches 412 is aligned with a respective one of the actuators 406 and the keycaps 302. Alternatively, more than one key 214 may be associated with each of the dome switches 412 and a predictive text or other software program or hardware may be utilized to determine the desired text. In those examples, the dome switches 412 may be offset relative to the actuators 406 and/or the keycaps 302.

In operation, the actuators 406 of the keyweb 304 provide stiffness to hold the keycaps 302 in position such that the domes switches 412 are in a non-deflected or non-collapsed position when the keys 214 are not pressed or actuated. A user can exert a force (e.g., downward force) on the keycap 302 to depress the keys 214 associated with the keycaps 302 with relative ease. The force required to press the key is large enough that the person can feel a resistance to the pressure of their finger on the keycaps 302. The electronic device 200 detects or senses a deflection or activation of the electrical switch 404 when the keycaps 302 are in a depressed position or actuated position relative to the front cover 210 to activate the electrical switch 404 and generate an electrical signal.

For example, to activate an electrical switch 404*a*, a user depresses a keycap 302*a* associated with the electrical switch 404*a* to provide data input to the electronic device 200. In particular, the electrical switch 404*a* generates an output signal that is received by a processor (e.g., the processor 102) when the keycap 302*a* is depressed by a user. When a user presses the keycap 302*a*, an actuator 406*a* of the keyweb 304 moves toward a trace pattern 414*a* of the printed circuit board 308. The actuator 406*a* presses against a dome switch 412*a* of the dome array 306 to cause the dome switch 412*a* to deflect, flex or bend toward the trace pattern 414*a* of the printed circuit board 308. In turn, the dome switch 412*a* collapses toward the conductive contacts 416 and 418 of the trace pattern 414*a* such that a contact surface of the dome switch 412*a* engages the conductive contacts 416 and 418 of the printed circuit board 308, thereby closing an electrical circuit and generating an electrical signal that is received or detected by the processor 102. For example, when the keycap 302*a* is activated, a character or value associated with keycap 302*a* is presented on the display 206.

To return the key to the non-actuated or initial position in which the electrical switch 404*a* is deactivated, a user releases the keycap 302*a*. When the keycap 302*a* is released, the actuator 406*a* returns to its original position or state and releases the dome switch 412*a*. The dome switch 412*a* also snaps back to its initial, original or dome shaped position. The dome switch 412*a* provides a tactile feedback (e.g., a force) to the user when the dome switch 412*a* snaps back to its original position. In particular, the dome switch 412*a* functions as a spring to push the actuator 406*a* back to the initial or non-activated position.

Figure 5:
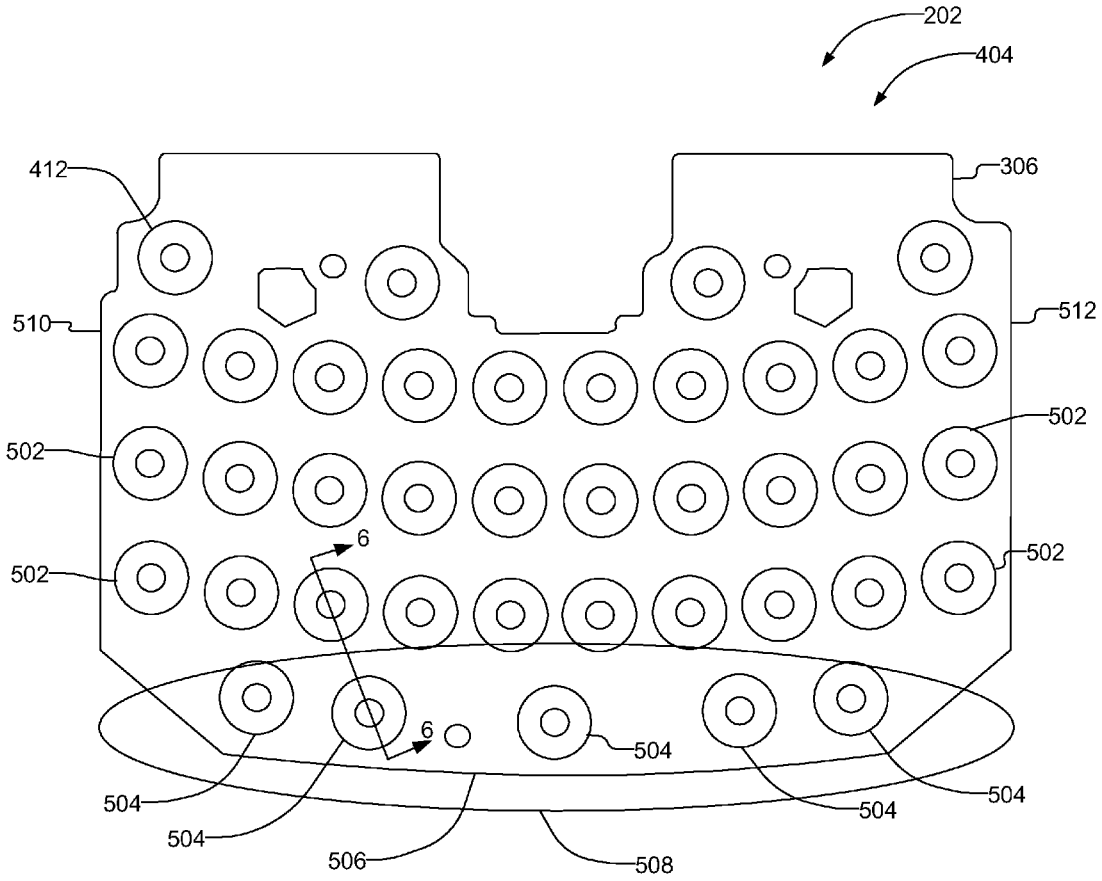
FIG. 5 is a plan view of an example electrical switch of the example keypad apparatus of FIGS. 2-4.

FIG. 5 is a plan view of the example dome array 306 of FIGS. 3 and 4. The dome array 306 of the illustrated example is a hybrid dome array in which the dome switches 412 of the dome array 306 includes a first plurality of dome switches 502 and a second plurality of dome switches 504 where the first dome switches 502 are composed of a first material and the second dome switches 504 are composed of a second material different than the first material. In the illustrated example, the first dome switches 502 and the second dome switches 504 are elastically deflectable between a relaxed position and a deflected position. The first plurality of dome switches 502 are metal domes. For example, the first dome switches 502 are metal springs composed of, for example, a thin plate-like metallic material and are formed into a dome-like shape and act as a conductor. Each of the first dome switches 502 may be formed by a tact spring having elasticity that snaps when pressed to provide a tactile feedback to a user.

The second plurality of dome switches 504 are each composed of plastic. For example, the second dome switches 504 are polydomes composed of, for example, polyethylene terephthalate (PET), and/or any other non-metallic material (s). The second dome switches 504 are formed into dome-like shapes and include a conductive material (e.g., conductive plating) to act as a conductor. For example, the second dome switches 504 are embossed domes that have relatively small conductive material or plating adjacent an apex of the second dome switch 504 to electrically couple to one of the traces 414 of the printed circuit board 308.

In the illustrated example of FIG. 5, the second dome switches 504 are positioned or disposed adjacent a first perimeter edge 506 of the dome array 306. For example, as shown, the dome array 306 includes a row 508 of second dome switches 504. In some examples, the second switch domes 504 may be positioned adjacent the perimeter edges 510 and 512 of the dome array 306. In some examples, the first dome switches 502 may be representative of higher use keys and the second dome switches 504 may be representative of lower use keys or less commonly used keys that are positioned adjacent an antenna of the electronic device 200. In other examples, the second dome switches 504 may be positioned in any suitable pattern and/or position on the dome array 306. For example, the first and second dome switches 502 and 504 may be positioned randomly or arbitrarily about the dome array 306.

Figure 6:
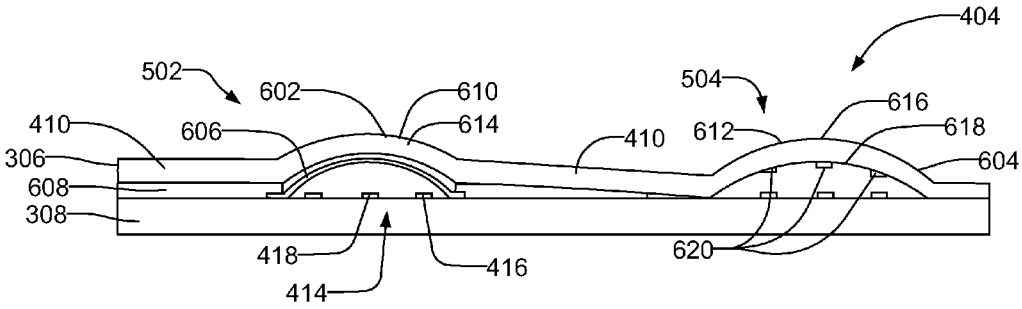
FIG. 6 is a cross-sectional view of a portion of the example electrical switch of FIGS. 2-5 taken along line 6-6 of FIG. 5.

FIG. 6 is a cross-sectional view of the example switch 404 taken along line 6-6 of FIG. 5. As shown in FIG. 6, a first dome switch 602 of the first plurality of dome switches 502 is positioned adjacent a second dome switch 604 of the second plurality of dome switches 504. The first dome switch 602 of the illustrated example includes a metal dome 606 positioned over or above the trace pattern 414 of the printed circuit board 308. The metal dome 606 is configured to provide a dome-snap profile to provide a click (e.g., an audible sound) or snap feel tactility to a user.

The carrier 410 of the illustrated example couples the metal dome 606 to the printed circuit board 308. More specifically, the metal dome 606 is positioned or attached to the carrier 410 and/or the printed circuit board 308 via an adhesive 608 (e.g., glue, etc.).

In the illustrated example of FIG. 6, the carrier 410 includes a first carrier portion 610 adjacent a second carrier portion 612. In particular, the first carrier portion 610 includes an embossment or embossed portion or dome 614 that provides a dome-like shape to enable the carrier 410 to nest or couple to the metal dome 606. In other words, the dome 614 in the first carrier portion 610 controls a pitch and/or a spacing of the metal dome 606 relative to the other first dome switches 502 (i.e., other metal domes) in the dome array 306. In this example, the dome 614 of the first carrier portion 610 is not configured to provide tactile feedback because the metal dome 606 provides tactile feedback. Additionally or alternatively, the first carrier portion 610 provides a seal to prevent the egress of dirt, moisture, or other elements toward the printed circuit board 308.

Additionally, the second carrier portion 612 defines the second dome switch 604 (e.g., the second dome switches 504 of FIG. 5). In other words, the second dome switch 604 is formed or defined by the second carrier portion 612 of the carrier 410. The second carrier portion 612 includes an embossment or embossed portion or dome 616 having a dome-like shape to define the second dome switch 604 (e.g., the second dome switches 504 of FIG. 5). However, unlike the dome 614 of the first carrier portion 610, the dome 616 of the second carrier portion 612 is configured, angled, shaped and/or formed to provide tactile feedback when activated or deflected toward the printed circuit board 308. In other words, the dome 616 of the second carrier portion 612 provides a dome-snap profile (e.g., similar to a dome-snap profile of a metal dome) to provide snap tactility. Thus, when activated, the dome 616 of the second carrier portion 612 provides a click (e.g., an audible sound) or snap feel that provides tactile feedback to a user. Additionally, an apex region or underside 618 of the dome 616 includes a conductive material, coating or plating 620 (e.g., localized conductive traces) to provide an electrical connection when the apex region 618 of the dome 616 is deflected into engagement with the trace pattern 414 of the printed circuit board 308 when a key associated with the dome 616 is activated or depressed.

The first and second carrier portions 610 and 612 of the illustrated example are composed of the same material. Further, the first and second carrier portions 610 and 612 of the illustrated example are composed as a unitary sheet. For example, the carrier portions 610 and 612 may be composed of a plastic material such as, for example, Polyethylene terephthalate (PET), polyester, nylon, polycarbonate and/or any other suitable material(s). During manufacturing, the dome 614 of the first carrier portion 610 is configured or shaped differently from the dome 616 of the second carrier portion 612 such that the embossment or dome 614 of the first carrier portion 610 does not provide tactility and the embossment or dome 616 of the second carrier portion 612 provides tactility or tactile feedback.

Figure 7:
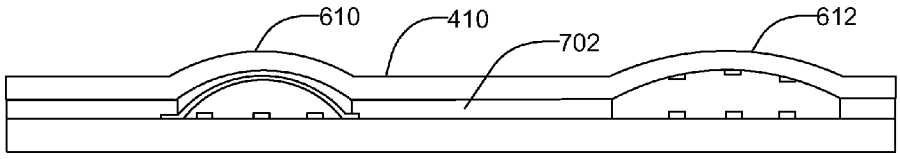
FIG. 7 is a cross-sectional view of another example electrical switch of a keypad apparatus in accordance with the teachings disclosed herein.

As shown in FIG. 6, an adhesive layer is not provided between the second carrier portion 612 and the printed circuit board 308. As shown in FIG. 7, in some examples, an adhesive layer 702 (e.g., glue) may be provided between the carrier 410 (e.g., the second carrier portion 612) and the printed circuit board 308 to provide a seal between the carrier 410 and the printed circuit board 308. For example, the adhesive layer 702 may be a continuous layer of adhesive disposed between the first and second carrier portions 610 and 612.

Figure 8:
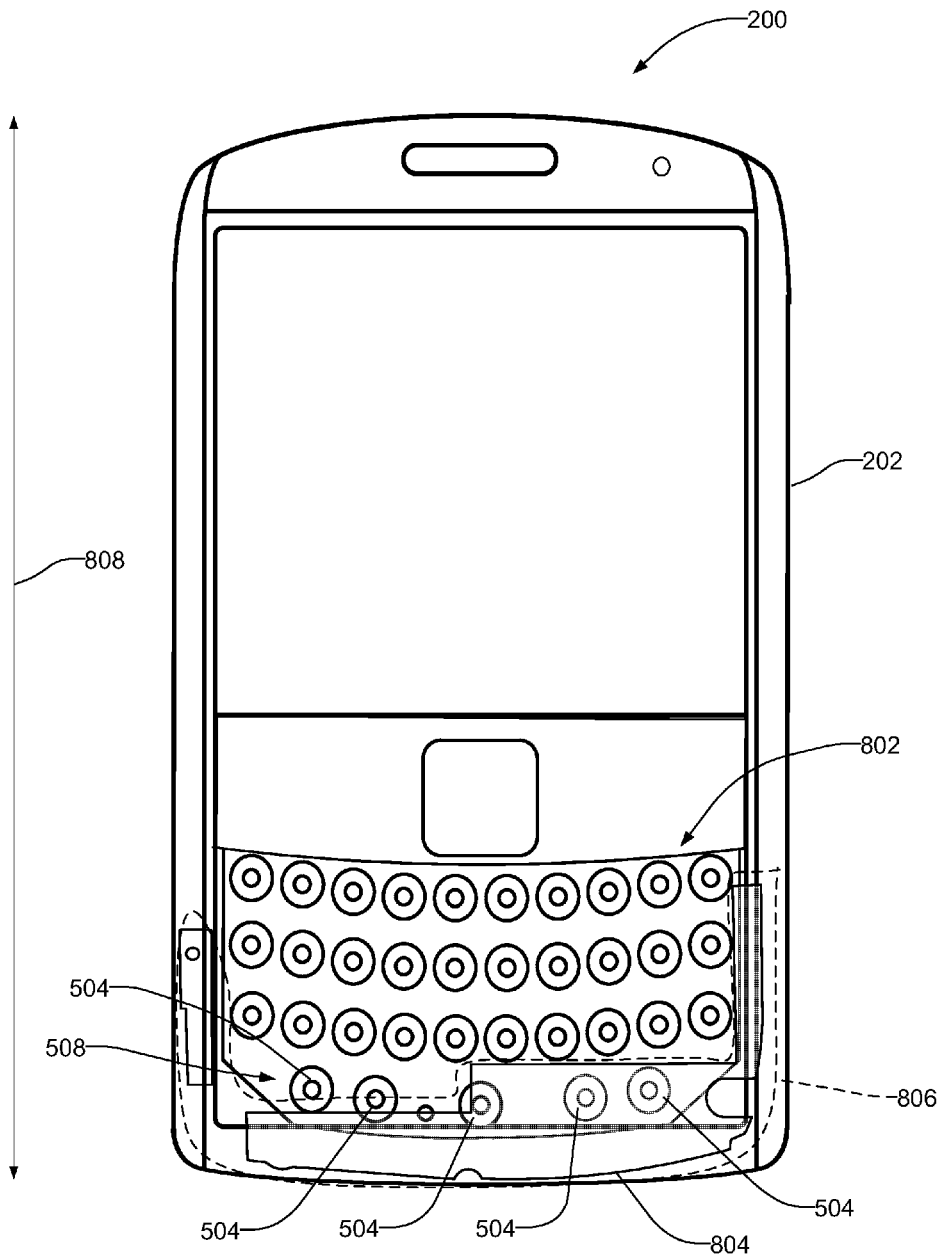
FIG. 8 illustrates the example keypad apparatus of FIGS. 2-6 positioned in a housing of the electronic device.

FIG. 8 illustrates a cutaway view of the electronic device 200 of FIG. 2. The housing 204 of the electronic device 200 defines a cavity or volume 802 to receive the electronic components of the electronic device 200. In particular, the cavity 802 receives the keypad apparatus 202 and an antenna 804. An antenna carrier is not shown for clarity. As shown in FIG. 8, at least a portion of the dome array 306 overlaps or shares a volume or perimeter of the cavity 802 with the antenna 804 (e.g., an antenna region 806). In particular, the second dome switches 504 (e.g., the row 508) at least partially overlap an antenna region 806 and/or the antenna 804. In operation, the second dome switches 504 do not interfere with or affect the performance of the antenna 804 because the second dome switches 504 are composed of a plastic material and employ minimal amounts of conductive material (e.g., metallic material). In other words, the non-metallic dome switches (e.g., the second dome switches 504) may be positioned to overlap the antenna 804 and/or the antenna region 806. As a result, overlapping the antenna 804 and the dome array 306 enables a dimensional value 808 (e.g., a length and/or width) of the electronic device 200 to be relatively shorter or more compact compared to an electronic device having a dome array composed of metal domes (e.g., having row 508 composed of metal domes), which would require an antenna to be positioned outside a perimeter of the dome array such that the antenna does not overlap a dome array. Thus, in this example, the row 508 of the second dome switches 504 share or overlap the antenna region 806 to make the housing 202 of the electronic device 200 relatively more compact (e.g., compared to a dome array in which the row 508 of dome switches is composed of metal dome) without adversely affecting antenna performance.

Figure 9:
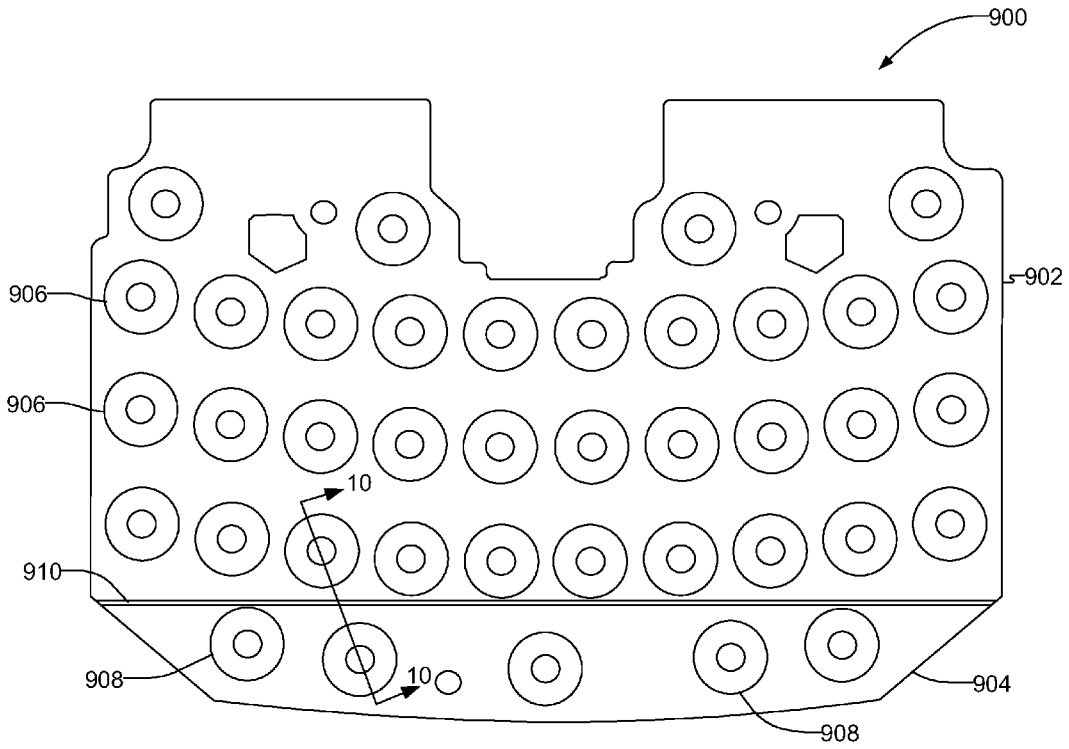
FIG. 9 illustrates another example keypad apparatus in accordance with the teachings disclosed herein.

FIG. 9 illustrates another example dome array 900 in accordance with the teachings disclosed herein that may be used to implement an electronic device such as, for example, the electronic device 100 of FIG. 1 or the electronic device 200 of FIG. 2. The example dome array 900 of FIG. 9 includes a first dome array 902 positioned or coupled to a second dome array 904. The first dome array 902 includes a first plurality of dome switches 906 and the second dome array 904 includes a second plurality of dome switches 908. Similar to the dome array 306 of FIGS. 2-6, the first dome array 902 includes one or more first dome switches 906 composed of a first material and the second dome array 904 includes one or more second dome switches 908 composed of a second material different than the first material. For example, the first dome switches 906 are composed of metal and the second dome switches 908 are composed of plastic. For example, the first dome switches 906 are metal domes and the second dome switches 908 are plastic domes (e.g., polydomes). A connector 910 couples or attaches the first dome array 902 and the second dome array 904. The connector 910 may be, for example, tape, adhesive and/or any other bonding agent and/or bonding technique (e.g., plastic welding) to couple or bond the first and second dome arrays 902 and 904.

Figure 10:
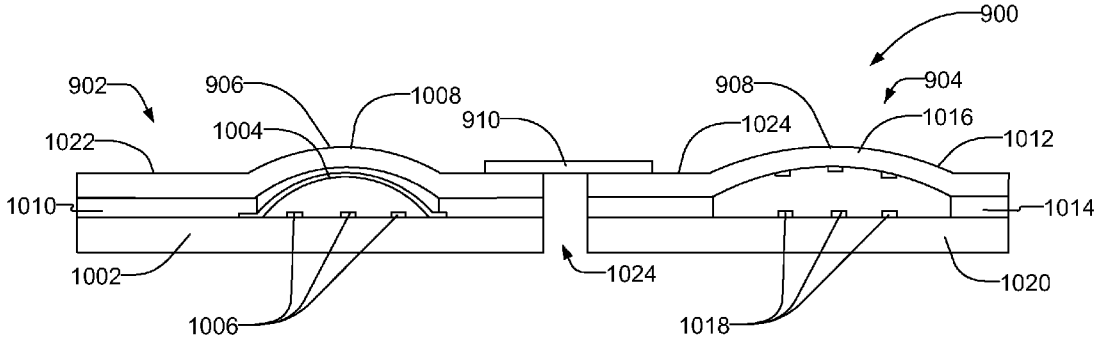
FIG. 10 is a cross-sectional view of a portion of the example keypad apparatus of FIG. 9 taken along line 10-10 of FIG. 9.

FIG. 10 is a cross sectional view of the example dome array 900 of FIG. 9 positioned relative to a printed circuit board 1002. Referring to FIG. 10, the first dome array 902 includes a metal dome 1004 positioned over a trace pattern 1006 of the printed circuit board 1002. As shown, the metal dome 1004 is coupled to a dome sheet or carrier 1008 (e.g., a thin film). In other words, the carrier 1008 interconnects the plurality of first dome switches 906 of FIG. 10. The carrier 1008 may be composed of, for example, an elastomeric material such as, for example, rubber, silicone or, alternatively, may be a plastic or polymer material (e.g. Mylar®) or any other transparent or semi-transparent resinous film. The carrier 1008 and, thus, the metal dome 1004 are coupled to the printed circuit board 1002 via an adhesive 1010. The metal dome 1004 provides tactility. Additionally, although the carrier 1006 is provided with a dome-like shape, the carrier 1006 of the illustrated example is not configured to provide tactile feedback. However, in other examples, the carrier 1006 may be configured to provide tactile feedback.

The second dome array 904 includes a carrier or sheet 1012 (e.g., a film) coupled to the printed circuit board 1002 via an adhesive 1014. The carrier 1012 includes an embossed portion or dome 1016 having a dome-like shape that defines one of the second dome switches 908. The dome 1016 is positioned over a trace pattern 1018 of a printed circuit board 1020. The carrier 1012 and/or the dome 1016 are composed of a plastic material such as, for example, Polyethylene terephthalate (PET), polyester, nylon, polycarbonate and/or any other suitable plastic material(s). The carrier 1008 may be composed of a first material and the carrier 1012 may be composed of a second material different than the first material of the carrier 1008. The dome 1016 of the carrier 1012 is configured or shaped to provide tactile feedback to a user when the dome 1016 of the carrier 1012 is deflected toward the printed circuit board 1020.

The connector 910 is positioned on an upper surface 1022 of the carrier 1008 and an upper surface 1024 of the carrier 1012 to bridge a gap 1026 between the first and second dome arrays 902 and 904. The connector 910 helps prevent dirt, moisture and/or other unwanted elements from passing through the gap 1026.

As a result of having the first dome array 902 and the second dome array 904, the first dome array 902 may be assembled or manufactured separately from the second dome array 904. After the first and second dome arrays 902 and 904 are manufactured and assembled, the first and second dome arrays 902 and 904 may be joined or connected via the connector 910. Such an approach may facilitate manufacturing and/or assembly of the dome array 900. However, in some examples, the first and second dome arrays 902 and 904 may be positioned over the printed circuit board 1002 and the adhesive layer 1010 may attach the carriers 1008 and 1012 to the printed circuit board 1002.

The example hybrid dome arrays disclosed herein can overlap an antenna or antenna region without negatively affecting antenna performance. For example, non-metallic domes of a keypad apparatus disclosed herein can overlap an antenna or antenna region of an electronic device without affecting or reducing antenna performance (e.g., without significantly interfering with antenna performance). As a result, the electronic device may employ a relatively smaller housing or casing, thereby reducing an overall dimensional envelope or footprint of the electronic device. Additionally, the hybrid dome arrays disclosed herein include metal domes to provide a relatively high cycle life. Further, both the metallic domes and non-metallic domes of the dome array provide tactile feedback. In other words, the non-metallic domes do not significantly compromise tactile performance.

The methods described herein may be carried out by software executed, for example, by the processor 102. Coding of software for carrying out such a method is within the scope of a person of ordinary skill in the art given the present description. A computer-readable medium having computer-readable code may be executed by at least one processor of the portable electronic device 100 to perform the methods described herein.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A keypad apparatus comprising:

a dome-switch assembly having:

a first plurality of domes composed of a first material, the first plurality of domes positioned outside an antenna region of a mobile device;

a second plurality of domes composed of a second material different from the first material, the second plurality of domes composed of a non-conductive material having a conductive trace, wherein the second plurality of domes overlap at least a portion of the antenna region of the mobile device; and a carrier to couple the first and second plurality of domes.

2. The keypad apparatus of claim 1, wherein the first plurality of domes are composed of metal.

3. The keypad apparatus of claim 1, wherein the second plurality of domes are composed of plastic.

4. The keypad apparatus of claim 1, wherein the second plurality of domes is formed via the carrier, and the first plurality of domes are metal domes attached to the carrier.

5. The keypad apparatus of claim 4, wherein the carrier is composed of a plastic material.

6. The keypad apparatus of claim 5, wherein the plastic material comprises polyethylene terephthalate (PET).

7. The keypad apparatus of claim 1, further comprising an adhesive to couple the carrier to a printed circuit board.

8. A mobile device comprising:

a housing;

an antenna disposed in the housing; and a keypad apparatus positioned in the housing, wherein at least a portion of the keypad apparatus overlaps the antenna, the keypad apparatus includes a dome-switch having at least:

a metal dome positioned outside of a perimeter defined by the antenna of the mobile device when coupled to the mobile device; and a non-metal dome having a localized conductive trace, the non-metal dome positioned adjacent the metal dome, the non-metal dome overlaps at least a portion of the antenna.

9. The mobile device of claim 8, wherein the metal dome and the non-metal dome provide tactile feedback when a key associated with the metal dome or the non-metal dome is activated.

10. The mobile device of claim 8, wherein the metal dome comprises a plurality of metal domes.

11. The mobile device of claim 8, wherein the non-metal dome comprises a plurality of non-metal domes.

12. The mobile device of claim 8, wherein the metal dome is coupled to a carrier.

13. The mobile device of claim 12, wherein the non-metal dome is formed by the carrier.

14. The mobile device of claim 8, further comprising a first carrier to couple the metal dome to a printed circuit board and a second carrier to couple the non-metal dome to the printed circuit board.

15. The mobile device of claim 14, further comprising a connector to couple the first carrier and the second carrier.

16. A keypad apparatus comprising:

a first dome sheet having a plurality of metal domes disposed over a printed circuit board and positioned outside of a perimeter defined by an antenna of the mobile device; and a second dome sheet having a plurality of plastic domes disposed over the printed circuit board and positioned inside at least a portion of the perimeter defined by the antenna of a mobile device.

17. The keypad apparatus of claim 16, further comprising an adhesive to couple the first dome sheet or the second dome sheet to the printed circuit board.

18. The keypad apparatus of claim 16, further comprising a connector to couple the first dome sheet and the second dome sheet.

19. The keypad apparatus of claim 18, wherein the connector comprises a tape.

20. The keypad apparatus of claim 16, wherein the first dome sheet is composed of silicone and the second dome sheet is composed of polyethylene terephthalate.

* * * * *

UNITED STATES PATENT AND TRADEMARK OFFICE

CERTIFICATE OF CORRECTION

PATENT NO. : 8,847,092 B2
APPLICATION NO. : 13/561914
DATED : September 30, 2014
INVENTOR(S) : John Paul Kudrna and Dietmar Frank Wennemer It is certified that error appears in the above-identified patent and that said Letters Patent is hereby corrected as shown below:

In the Claims,

Column 11, line 26 (Claim 8) insert --wherein-- between “dome,” and “the”

Signed and Sealed this
Twenty-fourth Day of March, 2015

Michelle K. Lee

Michelle K. Lee
*Director of the United States Patent and Trademark Office*